United States Patent [19]

Dollar

[11] 4,029,525

[45] June 14, 1977

[54] HIGH STRENGTH WROUGHT ZINC ALLOY

[75] Inventor: David L. Dollar, Greeneville, Tenn.

[73] Assignee: Ball Corporation, Muncie, Ind.

[22] Filed: Feb. 20, 1976

[21] Appl. No.: 659,613

Related U.S. Application Data

[60] Division of Ser. No. 573,292, April 30, 1975, Pat. No. 3,966,505, which is a continuation-in-part of Ser. No. 469,973, May 15, 1974, abandoned.

[52] U.S. Cl. ..... 148/32

[51] Int. Cl.[2] ..... C22F 1/16

[58] Field of Search ..... 75/178 AM; 148/32

[56] References Cited

UNITED STATES PATENTS

| | | | |
|---|---|---|---|
| 3,850,622 | 11/1974 | Balliet | 75/178 AM |
| 3,880,679 | 4/1975 | Gervais et al. | 75/178 AM |

*Primary Examiner*—W. Stallard

*Attorney, Agent, or Firm*—Gilbert E. Alberding

[57] ABSTRACT

This invention relates to a method and a stable alloy of zinc, the alloy having tensile strength in excess of 65,000 psi and a mechanical stability greater than 15 percent, the stable alloy being formed by homogenizing an alloy containing from about 20 to 28 weight percent aluminum, from about 0.1 to 3.5 percent copper, about 0.01 to about 0.5 percent magnesium, and the remainder zinc, at a temperature between about 550° F., to 750° F., to effect homogenization of the alloy, cooling the homogenized alloy to a rolling temperature of about 350° F., at a rate of about 10 to 50° F., per minute and thereafter rolling the homogenized alloy at a temperature below 350° F., to attain between 10 and 70 percent reduction thereof.

2 Claims, No Drawings

HIGH STRENGTH WROUGHT ZINC ALLOY

This is a division of application Ser. No. 573,292 filed Apr. 30, 1975 now U.S. Pat. No. 3,966,505 which is in turn a continuation-in-part of Ser. No. 469,973, filed May 15, 1974, and now abandoned.

BACKGROUND OF THE INVENTION

The present patent application is a continuation-in-part of copending commonly assigned application Ser. No. 469,973.

This invention relates to improved zinc alloys and is particularly directed to a method of providing a zinc-base alloy stock material having improved tensile strength and ductility at ambient temperatures and to the zinc-base alloy stock material produced thereby.

Zinc generally has been regarded as a metal with properties that render it unsuited for use in various stock articles. For example, zinc normally has low tensile strength and poor resistance to fracture at ambient temperatures and many formed articles which may be subjected to stresses at ambient temperatures accordingly have not heretofore been made commercially with zinc or zinc alloys.

Zinc generally is rolled at temperatures below 390° F., because its rollability is decreased at higher temperatures. When zinc is alloyed with various metals it has been found that there is generally a decrease in rollability with the result that higher rolling temperatures must be used. At any rate, temperatures in excess of 520° F., are not desirable since temperatures above that cause loss of mechanical properties of the rolled zinc alloy.

Hare, U.S. Pat. No. 3,676,115 discloses an alloy comprising zinc within the range 70–82 weight percent, aluminum in the range of 18–30 weight percent, and magnesium within the range greater than 0.05 to 0.25 weight percent. The alloy may contain up to 2 percent of one or more of the elements copper, nickel and silver. The patentee discloses for his zinc alloy composition a tensile strength of about 52,000 psi.

Chollet et al., U.S. Pat. No. 3,741,819 relates to an alloy consisting of 18–30 percent aluminum, up to 3 percent copper, up to 0.10 percent magnesium, up to 0.10 percent lithium, and the balance zinc. The patentee discloses a method of heat treating this alloy to enhance properties thereof by slow cooling the alloy from between about 380° C., and about 290° C. The Chollet et al., patent discloses a tensile strength for thier alloy of 43,600 psi.

Winter et al., U.S. Pat. No. 2,169,441 disclose that the working of an alloy comprising Zn-Al-Cu-Mg at a temperature ranging from 518° to 716° F., improve the machinability, tensile and impact strength of said composition. However, the relatively high copper content of this alloy and the disclosed annealing temperatures do not permit the production of a product with high tensile strength that can be obtained by the method of the present invention.

Gervais et al., U.S. Pat. No. 3,793,091 disclose that ternary and quaternary zinc-aluminum alloys are conditioned to exhibit superplastic behavior by hot-working thereof at temperatures between about 400° F., and the eutectoid temperatures of the alloy. The alloys of Gervais et al., are conditionable via rapid ice water quenching methods followed by hot working.

SUMMARY OF THE INVENTION

Briefly, in accordance with the subject invention, a method of manufacturing a stable high strength zinc alloy is disclosed having a tensile strength greater than 65,000 psi, the method comprising subjecting a Zn/Al/-Cu/Mg alloy containing from about 20 to about 28 percent by weight aluminum, from about 0.1 to about 3.5 percent copper, about 0.01 to about 0.5 weight percent magnesium, and the remainder zinc, to a temperature between about 550° F., to about 750° F., to effect homogenization of the alloy, cooling the homogenized alloy to a rolling temperature of about 350° F., at a rate of about 10° to 50° F., per minute, and thereafter rolling the homogenized alloy at a temperature below 350° F., to obtain at least 10 percent or greater percent reduction. Further, the subject invention is addressed to a zinc alloy having a homogenized structure, superior mechanical property stability and very high tensile strength, said alloy consisting essentially of about 20 to about 28 weight percent aluminium, about 0.1 to about 3.5 weight percent copper, about 0.01 to about 0.5 weight percent magnesium, and the remainder zinc.

It is a principal object of the instant invention to provide a method of producing novel homogeneous zinc-base alloys for shaping and forming various articles which exhibit markedly improved tensile strength, excellent ductility, and particularly property stability at ambient temperatures.

Another object of the subject invention is to provide a wrought alloy composition having enhanced stability over long periods of time without any significant loss in torque and tensile strength.

Another object of the instant invention is to provide novel homogeneous alloy compositions which may be a most advantageous substituted for conventional brass and aluminum alloy compositions without the inherent high production cost associated therewith.

These and other objects of the invention will become more readily apparent from the following detailed description.

DESCRIPTION OF THE PREFERRED EMBODIMENTS

The novel compositions described herein may be made by forming a melt which upon further treatment forms an alloy having a homogenized structure, the alloy containing from about 20 to 28 percent aluminium, from about 0.1 to 3.5 percent copper, about 0.01 to about 0.5 percent magnesium, and the remainder zinc. The forming of the alloy may be readily accomplished by incorporating the requisite ingredients in an induction furnace having proper means to thoroughly mix the melt. A number of conventional furnaces may be utilized for this purpose. The melt is generally poured upon a horizontal surface to form a thick sheet of solidified alloy. Examination of the crystalline structure of the solidified melt shows that there is formation of large dendrites. The alloy is generally thereafter subjected to heating above 525° F., so as to remove this dendritic, crystalline structure and to effect homogenization of the alloy. This may be readily accomplished by heating the alloy between a temperature of about 550° F., to about 750° F., for about 1 to about 20 hours. It will be appreciated that the as-cast alloy material may be rolled initially to produce a uniform sheet thickness and thereafter heated to effect homogenization thereof, or the as-cast material may be heated to homogenization and thereafter rolled to a desired thickness. In order to achieve a high tensile strength which remains stable for long periods of time the homogenized alloy must thereafter be subjected to cooling subsequent to homogenization of the alloy to a rolling temperature of about 350° F., at a cooling rate of about 10 to 50 F., per minute. Thereafter the alloy must be subjected to further mechanical working. This may be readily accomplished by rolling the homogenized alloy at a temperature below 350° F., to attain between about 10 and about 70 percent reduction thereof. Although there is some latitude as to the temperature of this final mechanical working of the homogenized alloy described herein it has been found preferable to roll work the alloy below about 350° F. Further, it has been found preferable to roll work the homogenized alloy between about 300° F., to about 350° F. With the compositions described herein as little as about 10 percent reduction in thickness achieves an alloy of excellent tensile strength which is very stable over a long period of time. A most preferable alloy is rendered when there is about at least 50 percent to about 70 percent reduction in thickness. Seemingly, not only is the tensile strength maintained at a most desirable strength but also the percent elongation is increased.

The term homogenizing means the production of a homogeneous alloy quality characterized by thoroughly disseminated Az/Al alloy phases throughout the matrix. This homogenizing may be readily accomplished by heating the alloy disclosed herein above the allotropic transformation temperature of 525° F., and preferably above 550° F., for at least sufficient time to completely homogenize the alloy. Thus, by heating above this temperature diffusion occurs whereby the dendrities are transformed into a uniform distribution of crystalline patterns creating a homogeneous alloy structure free of dendrities upon subsequent cooling below the transformation temperature. The cooling may be readily effected by various means such as conventional air cooling. The rate of cooling for the homogenized alloy should be between about 10° to about 50° F., per minute. In general, the term rolling temperature denotes a temperature of about 350° F. ± 25°. Thereafter, the homogenized alloy is subjected to forging or rolling at a temperature below 350° F., to obtain at least 10 or greater percent reduction.

It was noted that the properties of the material produced in accordance with this invention when subjected to accelerated ageing tests are very stable with time at room temperature with a nominal loss of only about 7 percent tensile strength in 10 years (estimated).

For the purpose of giving those skilled in the art a better understanding of the invention, as well as a better appreciation of the advantages of the invention, the following examples of the invention are given by way of illustration.

EXAMPLE I

An alloy having the following composition was made: aluminum 25.4 weight percent, copper 1.1 weight percent, magnesium 0.0165 weight percent, and the remaining percent being zinc. This alloy was prepared by melting a binary alloy metal comprising zinc and aluminum in an induction furnace and thereafter adding with stirring the requisite amount of copper, the furnace being maintained at about 1200° F. After all of the copper went into solution, about 2 weight percent magnesium in zinc alloy was added to obtain the required amount magnesium and the temperature was lowered to about 1100° F. The resulting alloy was thereafter cast and hot rolled above 525° F. The hot roll alloy was thereafter placed in an oven at 650° F., for about 17 hours to effect homogenization. Thereafter the homogenized alloy was air cooled to about 325° F., at a rate of about 30° F., per minute and then finish rolled to achieve a 70 percent reduction at a temperature of 325° F., (±10°). The resulting alloy had a hardness of about 66 Rockwell B and an ultimate tensile strength of about 67,400 psi with about 30 percent elongation. Upon subjecting a sample of the alloy to an accelerated ageing test whereby the sample was placed within an oven at about 200° F., for 10 days there was observed a decrease in tensile strength of about 10.5 percent. It is estimated (extrapolation of a hardness vs. log time plot) that this loss would be equivalent to ageing of the metal at room temperature for at least a minimum of 25 years.

EXAMPLE II

Enough aluminum was added to molten zinc in an induction furnace to provide about 25 weight percent aluminum. Copper was thereafter added to obtain analysis of about 1 percent by weight copper after complete melting at about 1100° F. Magnesium was thereafter added by plunging it beneath the surface of the molten metal resulting in an alloy having 25.1 weight percent aluminum, 1.0 weight percent copper, 0.03 weight percent magnesium, and the remainder being zinc. The thus formed alloy was hot rolled above about 525° F., and thereafter heated in an oven at about 650° F., for about 10 hours to effect homogenization. Thereafter, the alloy was air cooled to about 325° F., at a rate of about 30° F., per minute and then finish rolled to achieve a 57 percent reduction at a temperature of about 325° F., (±10°). Using an identical accelerated ageing test as in Example I, it was found that there was decrease in tensile strength of about 10 percent, equivalent to at least a minimum of 25 years.

The following properties were noted for the alloy formed in this example and compared with a conventional brass sample:

| | Alloy | Brass 65% Cu, 34% Zn, 1% Pb |
|---|---|---|
| Tensile Strength psi | 68,700 | 85,000 |
| Elongation % inch 2 inch | 17 | 5 |
| Hardness Rockwell B | 68 | 85 |
| Specific Gravity | 5.07 | 8.47 |
| Coefficient of Thermal Expansion | 27 | 20.3 |
| Liquid Temperature | 490° C. | 925° C. |
| Solidus Temperature | 375° C. | 885° C. |
| Specific Heat | 0.16 | 0.09 |

The tensile strength was carried out according to ASTM E-8-69 using a standard 0.5 inch sample with 2 inch gauge length with cross-head speed of 0.25 inches per minute. The ultimate tensile strength of longitudinal sections of alloy treated in accordance with this invention varied between about 65,000 to about 69,000 (psi) lbs., per square inch.

The hardness was determined by a Rockwell hardness device and ranged from about 65 to 70 on the metal.

It will be understood, of course, that modifications can be made in the preferred embodiments of the present invention as described hereinabove without departing from the scope and purview of the appended claims.

I claim:

1. A zinc alloy having superior age stability and tensile strength greater than 65,000 psi consisting of, by weight, 20–28 weight percent aluminum, 0.1 to 3.5 percent weight copper, 0.01 to about 0.5 weight percent magnesium, and the balance being zinc, said alloy having a homogenized structure.

2. A zinc alloy according to claim 1 consisting of 25 weight percent aluminum, 1 percent copper and about 0.03 percent magnesium.

* * * * *